United States Patent [19]

Higuchi et al.

[11] 4,112,193

[45] Sep. 5, 1978

[54] ELECTRICAL INSULATORS

[75] Inventors: Noboru Higuchi, Nagoya; Takayuki Ogasawara, Konan; Shoji Seike, Nagoya, all of Japan

[73] Assignee: Nippon Gaishi Kabushiki Kaishi, Nagoya, Japan

[21] Appl. No.: 711,165

[22] Filed: Aug. 3, 1976

[30] Foreign Application Priority Data

Nov. 11, 1975 [GB] United Kingdom ..... 46558/75

[51] Int. Cl.[2] ..... H01B 3/10; H01B 3/12

[52] U.S. Cl. ..... 428/539; 174/122 C; 174/137 A; 174/137 B

[58] Field of Search ..... 174/137 A, 137 B, 122 C; 428/539, 469, 472

[56] References Cited

U.S. PATENT DOCUMENTS

| | | | |
|---|---|---|---|
| 1,980,182 | 11/1934 | Brewster | 428/539 X |
| 2,772,190 | 11/1956 | Haayman et al. | 428/539 X |
| 2,797,175 | 6/1957 | Horton | 428/335 |
| 3,934,961 | 1/1976 | Itoh et al. | 428/539 X |

FOREIGN PATENT DOCUMENTS

| | | |
|---|---|---|
| 1,112,765 | 5/1968 | United Kingdom. |
| 812,858 | 5/1959 | United Kingdom. |
| 1,132,856 | 11/1968 | United Kingdom. |
| 1,106,226 | 3/1968 | United Kingdom. |
| 1,334,164 | 10/1973 | United Kingdom. |
| 982,600 | 2/1965 | United Kingdom. |

*Primary Examiner*—Harold Ansher
*Attorney, Agent, or Firm*—Lewis H. Eslinger

[57] ABSTRACT

The invention relates to an electrical insulator coated with a semi-conducting tin oxide system glaze layer wherein the glaze layer contains 0.05 to 10 percent by weight of at least one metal oxide selected from the group consisting of niobium oxide, tantalum oxide, titanium oxide, zirconium oxide, yttrium oxide and tungsten oxide. The additional metal oxide reduces the dependance of resistance on the environmental temperature.

3 Claims, 1 Drawing Figure

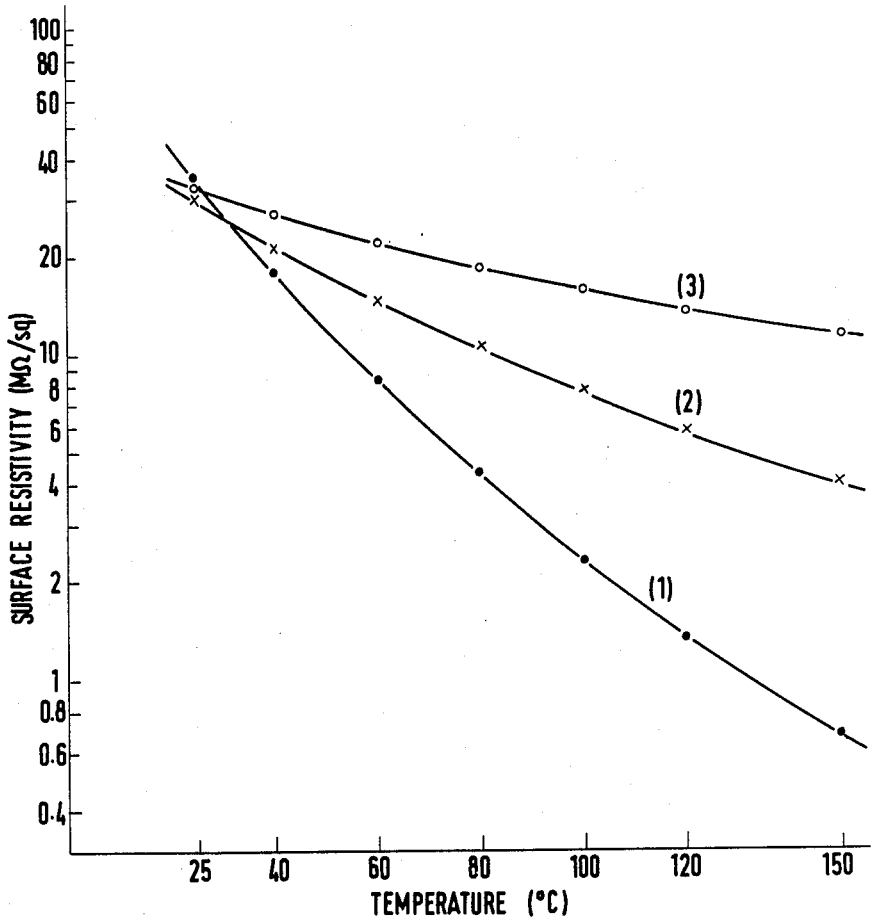
100
80
60
40
20
10
8
6
4
2
1
0.8
0.6
0.4
SURFACE RESISTIVITY (MΩ/sq)
(3)
(2)
(1)
25
40
60
80
100
120
150
TEMPERATURE (°C)

ELECTRICAL INSULATORS

The present invention relates to an electrical insulator on whose surface a tin oxide system semiconducting glaze is applied.

In an electrical insulator coated with a semiconducting glaze on the entire surface thereof, it is possible to attain remarkably improved electrical characteristics under polluted conditions in comparison with an ordinary glaze insulator, due to the advantage that a wet pollution material adhering to the insulator surface can be dried by the heating effect of a minute leakage current flowing through the semiconducting glaze layer, and also that the potential distribution along the insulator surface can be graded.

Consequently, the use of such a semiconducting glaze insulator in a pollution area serves well to decrease flashover faults caused by pollution, thereby accomplishing elimination of silicone greasing or over-insulation design employed as countermeasures against pollution.

It is desirable, in this case, that the surface resistivity of the semiconducting glaze is within a range from several megohms per square to several hundred megohms per square. It may be noted that the surface resistivity used here corresponds to the resistance value measured with electrodes attached to a pair of opposite sides of a cut-off square surface. When the surface is square in shape, the resistance value is irrelevant to its size, and is represented in the unit of ohm. However, in order to avoid confusion with the resistance value obtained by measurement with respect to the surface of any other shape, the dimension of the surface resistivity is expressed as ohm/square, ohm/sq (as herein) or ohm/cm$^2$. However, as with general semiconductors, the semiconducting glaze has such properties that its temperature coefficient of electrical resistance is negative and the resistance value decreases with the rise of the glaze temperature.

The temperature-resistance characteristics of this semiconducting glaze is represented by the following equation.

$$R = Ro \exp B\,(1/T - 1/To) \qquad (1)$$

where

R: Surface resistivity (MΩ/sq) at temperature T(° K.)

Ro: Surface resistivity (MΩ/sq) at temperature To(° K.)

B: Constant (° K.)

From Equation (1), the temperature coefficient $\alpha$ of electrical resistance is defined as $$\alpha = (1/R)\,dR/dT = -B/T^2 \qquad (2)$$

Thus, as the constant B in Equation (1) becomes further positive and greater, the temperature coefficient $\alpha$ of electrical resistance becomes further negative with its absolute value greater.

Generally, the B value of the semiconducting glaze ranges from hundreds to thousands (° K.) and, as described in Equation (2), the rate of the surface resistivity reduction resulting from temperature rise is greater as the B value is higher.

In this manner, since the temperature coefficient of electrical resistance of the semiconducting glaze is negative as already described, when there occurs a rise in the ambient temperature or a rise caused by the self heating effect, the surface resistivity of the semiconducting glaze decreases to permit a greater current flow. This phenomenon further brings about a glaze temperature rise, which may finally develop into thermal runaway in the worst case. Thus, it becomes impossible to maintain the necessary functions of support and insulation required for an insulator.

A semicomducting glaze containing iron oxide as the semiconducting oxide has been employed for a semiconducting glaze insulator, but failed to attain wide application because of the disadvantage that thermal runaway is liable to occur in the insulator since the B value in Equation (1) is as high as 3,000 to 5,000 (° K.) and the surface resistivity decreases sharply with a temperature rise.

The FIGURE of the accompanying drawing shows examples of the temperature-resistance characteristics of semiconducting glazes, wherein curve (1) represents the characteristics of an iron oxide system semiconducting glaze with temperature, in which a semiconducting oxide composed principally of iron oxide is present as 25% by weight in the conventional ceramic glaze composition; and curves (2) and (3) represent the characteristics of tin oxide system conducting glazes which will be described below.

The semiconducting glaze insulator developed since the iron oxide glaze includes a coating of a tin oxide system semiconducting glaze using a tin oxide - antimony oxide mixture as the semiconducting oxide. This semiconducting glaze is described, for example, in the British Pat. Nos. 982,600, 1,098,958 and 1,112,765.

In general, the tin oxide system semiconducting glaze is obtained by mixing tin oxide with antimony oxide in the ratio of 70:30 to 99:1 by weight, subsequently calcining the oxide mixture at a predetermined temperature, and further mixing it with an ordinary ceramic glaze composition (hereinafter referred to as base glaze). The mixture of tin oxide and antimony oxide does not always require calcination, and merely a predetermined amount of the tin oxide and the antimony oxide may be mixed with the base glaze. The mixing rate of the tin oxide - antimony oxide mixture against the base glaze ranges normally from 3 to 50 percent by weight.

The temperature dependency of resistance of such a tin oxide system semiconducting glaze is small and its B value ranges approximately from 1,000 to 2,500 (° K.). Therefore, the danger of thermal runaway is considerably decreased in comparison with an iron oxide system semiconducting glaze. However, even in the insulator having the above-mentioned tin oxide system semiconducting glaze, under extremely severe conditions where ambient temperature is very high and an overvoltage is impressed for many hours, the input power comes to exceed the dissipation power determined by the difference between the insulator temperature and the ambient temperature, thereby causing a danger of thermal runaway or thermal breakdown.

When the insulator coated with the tin oxide system semiconducting glaze is used under severe polluted conditions for a long time, there is observed electrolytic corrosion in that micro-pittings of the glaze are formed to roughen the glaze surface. Although such electrolytic corrosion can be prevented by increasing the amount of the semi-conducting oxide in the glaze, there still exists a problem in that an increase of the semiconducting oxide in the glaze renders the B value of the glaze greater and results in deterioration of the thermal stability. Accordingly, in a range where the amount of the semiconducting oxide is large in the glaze, it is particularly necessary for the B value to be maintained small.

The aim of the present invention is to reduce these disadvantages.

According to the present invention there is provided an electrical insulator coated with a semiconducting tin oxide system glaze layer wherein the glaze layer contains 0.05 to 10 percent by weight of at least one metal oxide selected from the group consisting of niobium oxide, tantalum oxide, titanium oxide, zirconium oxide, yttrium oxide and tungsten oxide.

Preferably the said at least one metal oxide comprises 0.1 to 8 percent by weight of the glaze layer. Of these oxides, niobium oxide, tantalum oxide, zirconium oxide and yttrium oxide are most preferred.

An electrical insulator of the present invention may be obtained by preparing the aforementioned semiconducting glaze composition, subsequently adding water thereto with complete mixing and agitation to produce a glaze slip, then applying the glaze slip onto the surface of an insulator body by an ordinary method such as dipping or spraying, and finally firing it by a conventional firing method employed for the insulator.

In the present invention, the ratio of tin oxide to antimony oxide in the tin oxide system can be from 70:30 to 99:1 by weight, and the mixing ratio of the semiconducting oxide mixture composed of tin oxide and antimony oxide to the glaze base can be from 3 to 50 percent by weight, as in general in tin oxide system semiconducting glazes.

In manufacture of an electrical insulator of the invention having a semiconducting glaze, the ratio of tin oxide to antimony oxide and the mixing ratio of the semiconducting oxide to the glaze base are selected within the above ranges having regard to the chemical composition of the base glaze, the chemical composition and crystalline composition of the porcelain body, firing conditions, and the resistance-temperature characteristics and corrosion resistance of the semiconducting glaze obtained.

Limitation of the maximum amount of the additional metal oxide to 10 percent by weight is based on the reason that, if any more is used, the surface resistivity of the semiconducting glaze exceeds 1,000 megohms per square which disables the semiconducting glaze insulator from working with satisfactory characteristics under polluted conditions. Limitation of the minimum amount of the additional metal oxide to 0.05 percent by weight is based on the reason that any smaller amount fails to give the desired effects of decreasing the temperature coefficient of resistance of the glaze. A proportion of 0.1 to 8 percent by weight of the additional metal oxide is preferable for these reasons.

EXAMPLE 1

Tin oxide (95 percent by weight) was mixed with antimony trioxide (5 percent by weight) and 29 percent of the oxide mixture by weight was further mixed with 3 percent niobium oxide by weight and 68 percent glaze composition by weight of which chemical composition in Seger formula consisted of KNaO 0.40, CaO 0.30, MgO 0.30, $Al_2O_3$ 0.75 and $SiO_2$ 6.00. Subsequently, water (65 parts by weight) was added to 100 parts by weight of the mixture, which was then pulverised and mixed by a ball mill to produce a semiconducting glaze slip.

The glaze slip was applied onto the entire surface of a 250 mm disc insulator body by a dipping method to form a glaze layer of 0.27 to 0.33 mm in thickness, and after drying, it was fired at a maximum temperature of 1,280° C. After firing, the surface resistivity and the resistance-temperature characteristics were measured. The surface resistivity was in a range from 30 to 52 megohms per square and the resistance-temperature characteristics indicated the curve (3) plotted in the accompanying graph were noted. The B value in Equation (1) was 1,080 (° K.). In the meantime, for obtaining a semiconducting glaze without any niobium oxide, tin oxide (95 percent by weight) was mixed with antimony oxide (5 percent by weight,) and the oxide mixture (29 percent by weight) was further mixed with a glaze composition (71 percent by weight) of which chemical composition in Seger formula consisted of KNaO 0.40, CaO 0.30, MgO 0.30, $Al_2O_3$ 0.75 and $SiO_2$ 6.00. Subsequently, water (65 parts by weight) was added to the mixture (100 parts by weight,) which was then pulverised and mixed to produce a glaze slip. The slip thus obtained was applied onto the entire surface of a 250 mm disc insulator body to form a glaze layer of 0.24 to 0.30 mm in thickness, and after drying, it was fired at a maximum temperature of 1,280° C. After firing, the surface resistivity measured was in a range from 25 to 43 megohms per square, and the resistance-temperature characteristics indicated the curve (2) plotted in the accompanying graph were obtained. The B value in this case was 1,980 (° K.).

In order to evaluate the thermal stability of those disc insulators, caps and pins were cemented to each insulator, and the thermal runaway withstand voltage was measured at an ambient temperature of 25° C. This voltage denotes the maximum applied voltage at which no thermal runaway occurs in the insulator under certain conditions. More specifically, it means the maximum voltage that causes no thermal breakdown of the porcelain at a test voltage applied for two hours or so under predetermined ambient conditions.

The thermal runaway withstand voltage of the insulator having the semiconducting glaze without containing any niobium oxide was 22 kilovolt, while the withstand voltage of the insulator coated with the semiconducting glaze containing niobium oxide was 32 kilovolt. Thus, an improvement of 10 kilovolt was achieved in the thermal runaway withstand voltage.

From the above results, it is obvious that the semiconducting glaze containing niobium oxide is remarkably effective in improving the thermal stability of the insulator while curves (2) and (3) also illustrate the beneficial effect of the niobium oxide in withstanding high temperatures.

EXAMPLE 2

The semiconducting glaze slips shown in Table 1 were prepared. The glazes Nos. 1 through 4 were applied onto a 33 kilovolt line post insulator body whose core diameter after the firing was 80 mm, and the glazes Nos. 5 through 7 were applied onto a test specimen measuring 20 mm by 40 mm by 60 mm. The thickness of each glaze layer is given in Table 1. After application of each glaze slip, it was dried and then fired at the temperature shown in Table 1. After the cooling step, the surface resistivity and the resistance-temperature characteristics were measured. With regard to the line post insulator, hardwares were cemented thereto, and the thermal runaway withstand voltage was measured at an ambient temperature of 25° C. The results of this measurement are listed in Table 1.

It will be understood from Table 1 that glazes Nos. 2 through 4 containing tantalum oxide, titanium and yttrium oxide respectively, present a smaller B value as compared with the glaze No. 1 which does not contain any such oxides, and also that an improvement is achieved in the thermal runaway withstand voltage by applying the new glaze to the line post insulator. Furthermore, it will be understood that glazes Nos. 6 and 7 containing zirconium oxide and tungsten oxide respectively present a smaller B value as compared with the glaze No. 5 which does not contain either of such oxides, and that improved resistance-temperature characteristics are achieved.

ranging from 20 to 70 megohms per square was obtained. The resistance-temperature characteristics were measured after firing, and the results are listed as the B value in Table 2. Although the B value differs with the amount of tin oxide and antimony oxide in the glaze, it is seen from this table that, for any given amount of semiconducting oxide, the glaze containing the additional metal oxide such a niobium oxide or yttrium oxide, according to the present invention, had a smaller B value than any glaze that did not contain such oxide, and a great improvement is provided with respect to the resistance-temperature characteristics. The glazes Nos. 8 through 25 were obtained by the use of two kinds of additional metal oxides, and the glazes Nos. 26 through 36 are examples using three or more additional metal oxides. In the latter case, using three or more additional metal oxides, there may be other suitable combinations of the oxides beyond those shown in Table 2. In any of them, however, the glaze containing additional metal oxides presents a smaller B value than the glaze without any additional metal oxide, and the resistance-temperature characteristics are improved.

Table 1

| Glaze No. | | | 1 | 2 | 3 | 4 | 5 | 6 | 7 |
|---|---|---|---|---|---|---|---|---|---|
| Semiconducting glaze composition (weight %) | $SnO_2$ | | 32.3 | 32.3 | 32.3 | 32.3 | 20.4 | 20.4 | 20.4 |
| | $Sb_2O_3$ | | 1.7 | 1.7 | 1.7 | 1.7 | 0.6 | 0.6 | 0.6 |
| | Additional metal oxide | | None | $Ta_2O_5$ 3.0 | $TiO_2$ 1.0 | $Y_2O_3$ 4.0 | None | $ZrO_2$ 2.0 | $WO_3$ 7.0 |
| | Base glaze | Composition (Note 1) | (A) | (A) | (A) | (A) | (B) | (B) | (B) |
| | | Quantity | 66.0 | 63.0 | 65.0 | 62.0 | 79.0 | 77.0 | 72.0 |
| Preparation | Test body | | 33 kilovolt line post insulator | | | | | Test specimen | |
| Condition | Glaze thickness before firing (mm) | | 0.20–0.26 | 0.32–0.38 | 0.30–0.37 | 0.32–0.38 | 0.28–0.34 | 0.33–0.40 | 0.35–0.43 |
| | Firing temperature (° C) | | 1280 | 1280 | 1280 | 1280 | 1270 | 1270 | 1270 |
| Characteristics | Surface resistivity (MΩ/sq) | | 24–51 | 23–65 | 19–53 | 30–75 | 33–65 | 30–73 | 28–56 |
| | B value (° K) | | 2030 | 1370 | 1540 | 1350 | 1310 | 810 | 760 |
| | Thermal runaway withstand voltage (kv) | | 40 | 63 | 52 | 63 | / | / | / |

Note 1 Base glaze composition (Seger formula)

(A) KNaO 0.4, CaO 0.3, MgO 0.3 } $Al_2O_3$ 0.75 $SiO_2$ 6.5

(B) KNaO 0.3, CaO 0.5, MgO 0.2 } $Al_2O_3$ 0.6 $SiO_2$ 5.5

EXAMPLE 3

The semiconducting glaze slips shown in Table 2 were prepared and applied to test specimens measuring 20 mm by 40 mm by 60 mm. After drying, each was fired at the temperature given in Table 2. The glaze layer thickness of Nos. 8 through 36 was within a range from 0.20 to 0.40 mm so that the surface resistivity Table 2

| Glaze No. | Semiconducting glaze composition (wt %) $SnO_2$ | $Sb_2O_3$ | Additional metal oxide | | | | | | Base glaze Composition (Note 1) | Base glaze Quantity | Firing (° C) | B value (° K) |
|---|---|---|---|---|---|---|---|---|---|---|---|---|
| 8 | 33.3 | 1.7 | None | | | | | | (C) | 65 | 1270 | 2120 |
| 9 | 33.3 | 1.7 | $Nb_2O_5$ | 1.0 | $Ta_2O_5$ | 2.0 | | | (C) | 62 | 1270 | 1310 |
| 10 | 33.3 | 1.7 | $Nb_2O_5$ | 2.0 | $TiO_2$ | 0.5 | | | (C) | 62.5 | 1270 | 1390 |
| 11 | 33.3 | 1.7 | $Nb_2O_5$ | 2.5 | $Y_2O_3$ | 2.0 | | | (C) | 60.5 | 1270 | 1180 |
| 12 | 33.3 | 1.7 | $Nb_2O_5$ | 1.5 | $ZrO_2$ | 0.5 | | | (C) | 63 | 1270 | 1450 |
| 13 | 33.3 | 1.7 | $Nb_2O_5$ | 2.0 | $WO_3$ | 4.0 | | | (C) | 59 | 1270 | 1300 |
| 14 | 26.9 | 1.1 | None | | | | | | (A) | 72 | 1280 | 1750 |
| 15 | 26.9 | 1.1 | $Ta_2O_5$ | 2.0 | $TiO_2$ | 0.5 | | | (A) | 1630 | 1280 | 1280 |
| 16 | 26.9 | 1.1 | $Ta_2O_5$ | 1.0 | $Y_2O_3$ | 2.0 | | | (A) | 69 | 1280 | 1030 |
| 17 | 26.9 | 1.1 | $Ta_2O_5$ | 1.0 | $ZrO_2$ | 1.5 | | | (A) | 69.5 | 1280 | 1340 |
| 18 | 26.9 | 1.1 | $Ta_2O_5$ | 2.0 | $WO_3$ | 3.0 | | | (A) | 67 | 1280 | 1300 |
| 19 | 26.9 | 1.1 | $TiO_2$ | 0.5 | $Y_2O_3$ | 2.0 | | | (A) | 69.5 | 1280 | 1100 |
| 20 | 26.9 | 1.1 | $TiO_2$ | 0.5 | $ZrO_2$ | 1.0 | | | (A) | 70.5 | 1280 | 1260 |
| 21 | 26.9 | 1.1 | $TiO_2$ | 0.3 | $WO_3$ | 3.0 | | | (A) | 68.7 | 1280 | 1310 |
| 22 | 16.2 | 1.8 | None | | | | | | (B) | 82 | 1260 | 1230 |
| 23 | 16.2 | 1.8 | $Y_2O_3$ | 1.5 | $ZrO_2$ | 0.5 | | | (B) | 80 | 1260 | 710 |
| 24 | 16.2 | 1.8 | $Y_2O_3$ | 0.5 | $WO_3$ | 1.5 | | | (B) | 80 | 1260 | 630 |
| 25 | 16.2 | 1.8 | $ZrO_2$ | 0.5 | $WO_3$ | 2.0 | | | (B) | 79.5 | 1260 | 820 |
| 26 | 39.1 | 2.9 | None | | | | | | (A) | 58 | 1280 | 2520 |
| 27 | 39.1 | 2.9 | $Nb_2O_5$ | 3.0 | $TiO_2$ | 0.5 | $Y_2O_3$ | 2.0 | (A) | 52.5 | 1280 | 1620 |
| 28 | 39.1 | 2.9 | $Ta_2O_5$ | 2.0 | $ZrO_2$ | 1.0 | $WO_3$ | 4.0 | (A) | 51 | 1280 | 1970 |
| 29 | 39.1 | 2.9 | $Nb_2O_5$ | 2.0 | $Y_2O_3$ | 2.0 | $Ta_2O_5$ | 1.0 | (A) | 53 | 1280 | 1710 |

Table 2-continued

| Glaze No. | $SnO_2$ | $Sb_2O_3$ | Additional metal oxide | | | | | Base glaze Composition (Note 1) | Base glaze Quantity | Firing (° C) | B value (° K) |
|---|---|---|---|---|---|---|---|---|---|---|---|
| | | | Semiconducting glaze composition (wt %) | | | | | | | | |
| 30 | 23.5 | 1.5 | | | None | | | (C) | 75 | 1270 | 1560 |
| 31 | 23.5 | 1.5 | $Nb_2O_5$ 0.8 | $TiO_2$ 0.2 | $ZrO_2$ 0.3 | $Y_2O_3$ 0.7 | | (C) | 73 | 1270 | 1090 |
| 32 | 23.5 | 1.5 | $Nb_2O_5$ 0.5 | $Ta_2O_5$ 0.7 | $WO_3$ 1.0 | $Y_2O_3$ 0.8 | | (C) | 72 | 1270 | 960 |
| 33 | 23.5 | 1.5 | $Y_2O_3$ 1.0 | $TiO_2$ 0.2 | $Ta_2O_5$ 0.8 | $ZrO_2$ 0.5 | | (C) | 72.5 | 1270 | 1020 |
| 34 | 28.5 | 1.5 | | | None | | | (B) | 70 | 1260 | 1830 |
| 35 | 28.5 | 1.5 | $Nb_2O_5$ 0.7 | $Ta_2O_5$ 0.3 | $TiO_2$ 0.1 | $Y_2O_3$ 0.8 | $WO_3$ 0.8 | (B) | 67.3 | 1260 | 1210 |
| 36 | 28.5 | 1.5 | $Nb_2O_5$ 0.8 $WO_3$ 0.7 | $Ta_2O_5$ 0.8 | $TiO_2$ 0.1 | $Y_2O_3$ 0.4 | $ZrO_2$ 0.3 | (B) | 66.9 | 1260 | 1300 |

Note 1; Base glaze composition (Seger formula)
(A), (B) Same as in Example 2 of Table I (C) KNaO 0.4, CaO 0.4, MgO 0.2 } $Al_2O_3$ 0.7 $SiO_2$ 6.0

As is obvious from the above description, in the semiconducting glazes of the present invention that contain one or more of niobium oxide, tantalum oxide, titanium oxide, zirconium oxide, yttrium oxide and tungsten oxide in the proportion 0.05 to 10 percent by weight in a tin oxide system semiconducting glaze composition consisting of tin oxide, antimony oxide and base glaze, the temperature dependence of the surface resistivity of the glaze is reduced as compared with the general tin oxide system semiconducting glaze consisting merely of tin oxide, antimony oxide and base glaze.

Consequently, in electrical insulators coated with the semiconducting glaze according to the present invention, a noticeable improvement is attained in its thermal stability with a remarkable reduction in the danger of thermal runaway, thereby reducing the disadvantages of the conventional insulator having an ordinary semiconducting glaze. Thus, it is rendered possible to realise, in polluted areas, wide applications of the semiconducting glaze insulator equipped with high thermal stability as well as excellent characteristics under polluted conditions and excellent corona characteristics which are the intrinsic features of the semiconducting glaze, whereby considerable curtailment is accomplished in the expenses for maintenance including silicone greasing or in the expenses consequent upon over-insulation design.

It is to be noted here that the present invention is not restricted to the semiconducting glaze insulator coated with the semiconducting glaze on the entire surface thereof, but is also applicable to an insulator coated partially with the semiconducting glaze on a portion where a large potential difference occurs, such as the vicinity of electrodes or the periphery of hardware such as caps and pins.

We claim:

1. An electrical insulator coated on its entire surface with a semi-conducting tin oxide system glaze comprising a tin oxide-antimony oxide mixture, wherein the glaze layer contains 0.05 to 10 percent by weight of at least one metal oxide selected from the group consisting of niobium oxide, tantalum oxide, titanium oxide, zirconium oxide, yttrium oxide and tungsten oxide.

2. An electrical insulator according to claim 1, wherein the glaze layer contains at least one metal oxide selected from the group consisting of niobium oxide, tantalum oxide, zirconium oxide and yttrium oxide.

3. An electric insulator according to claim 1, wherein the at least one metal oxide is 0.1 to 8 percent by weight of the glaze layer.

* * * * *